US007789441B1

(12) United States Patent
Conway

(10) Patent No.: US 7,789,441 B1
(45) Date of Patent: Sep. 7, 2010

(54) DOG WASTE COLLECTING ASSEMBLY

(76) Inventor: Daniel M. Conway, 14435 N. 66th Pl., Scottsdale, AZ (US) 85254

( * ) Notice: Subject to any disclaimer, the term of this patent is extended or adjusted under 35 U.S.C. 154(b) by 9 days.

(21) Appl. No.: 12/371,796

(22) Filed: Feb. 16, 2009

(51) Int. Cl.
*A01K 29/00* (2006.01)

(52) U.S. Cl. ..... 294/1.3

(58) Field of Classification Search ..... 294/1.3, 294/1.4, 31.2, 16, 119.2; 248/99, 101
See application file for complete search history.

(56) References Cited

U.S. PATENT DOCUMENTS

| | | | | | |
|---|---|---|---|---|---|
| 1,265,996 | A | * | 5/1918 | Cerny | 248/99 |
| 1,468,709 | A | * | 9/1923 | La Grandeur et al. | 294/1.1 |
| 2,428,499 | A | * | 10/1947 | Nelson | 294/33 |
| 2,649,604 | A | * | 8/1953 | Hess | 294/1.3 |
| 3,786,780 | A | | 1/1974 | Pezzino | |
| 3,942,832 | A | | 3/1976 | Haas, Jr. | |
| 3,984,139 | A | * | 10/1976 | Battaglia | 294/1.4 |
| 4,003,595 | A | * | 1/1977 | Fano et al. | 294/1.5 |
| 4,023,842 | A | | 5/1977 | Harvey | |
| 4,341,410 | A | * | 7/1982 | Summach | 294/1.3 |
| D290,416 | S | * | 6/1987 | Breuer | D30/162 |
| 5,080,308 | A | | 1/1992 | Franks | |
| 6,030,010 | A | | 2/2000 | Graeff | |
| 6,039,370 | A | | 3/2000 | Dooley, Jr. et al. | |
| D461,027 | S | | 7/2002 | Gardner | |
| 6,530,690 | B2 | * | 3/2003 | Smith et al. | 383/12 |
| 7,204,532 | B2 | * | 4/2007 | Lefevre | 294/1.5 |
| 7,278,377 | B1 | | 10/2007 | Stephens | |
| 7,350,547 | B2 | | 4/2008 | Quiring | |

FOREIGN PATENT DOCUMENTS

| | | | |
|---|---|---|---|
| WO | WO 02071838 | * | 9/2002 |

* cited by examiner

*Primary Examiner*—Paul T Chin

(57) ABSTRACT

A dog waste collecting assembly that includes a loop that having a break therein to define a first free end and a second free end. The loop is comprised of a resiliently bendable material that resists abutment of the first free end and the second free. A handle is attached to the loop. The loop is extendable into an open end of a bag when the first and second free ends are urged together. The first and second free ends are then allowed to move apart from each other to frictionally engage the bag to allow the bag to receive waste scooped up with the loop.

6 Claims, 6 Drawing Sheets

DOG WASTE COLLECTING ASSEMBLY

BACKGROUND OF THE INVENTION

Field of the Invention

The present invention relates to dog waste collecting devices and more particularly pertains to a new dog waste collecting device for assisting a person in collecting dog waste.

SUMMARY OF THE INVENTION

The present invention meets the needs presented above by generally comprising a loop that has a break therein to define a first free end and a second free end. The loop is comprised of a resiliently bendable material that resists abutment of the first free end and the second free. A handle is attached to the loop. The loop is extendable into an open end of a bag when the first and second free ends are urged together. The first and second free ends are then allowed to move apart from each other to frictionally engage the bag to allow the bag to receive waste scooped up with the loop or pushed through the loop.

There has thus been outlined, rather broadly, the more important features of the invention in order that the detailed description thereof that follows may be better understood, and in order that the present contribution to the art may be better appreciated. There are additional features of the invention that will be described hereinafter and which will form the subject matter of the claims appended hereto.

The objects of the invention, along with the various features of novelty which characterize the invention, are pointed out with particularity in the claims annexed to and forming a part of this disclosure.

BRIEF DESCRIPTION OF THE DRAWINGS

The invention will be better understood and objects other than those set forth above will become apparent when consideration is given to the following detailed description thereof. Such description makes reference to the annexed drawings wherein.

DESCRIPTION OF THE PREFERRED EMBODIMENT

Figure 1:
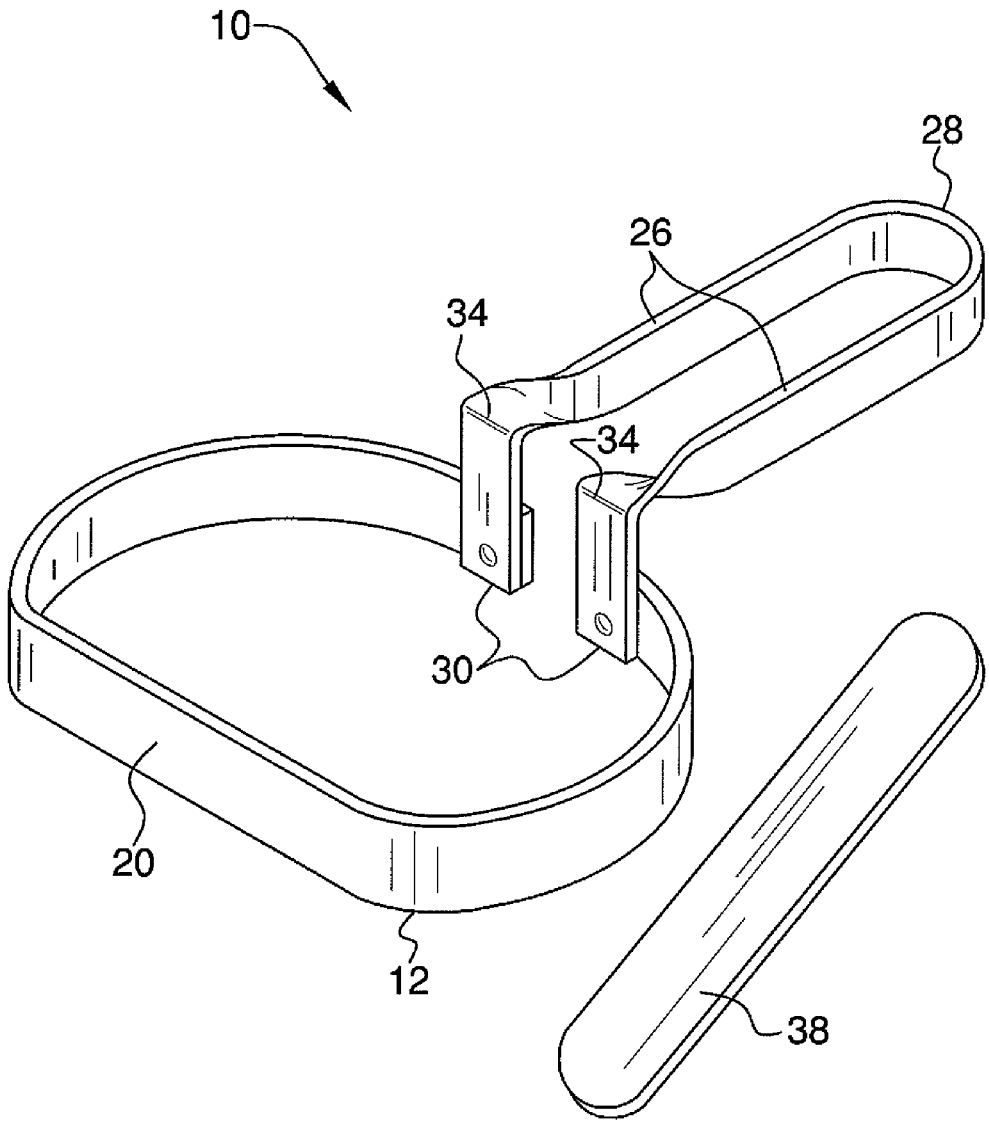
FIG. 1 is a top perspective view of a dog waste collecting assembly according to the present invention.
Figure 2:
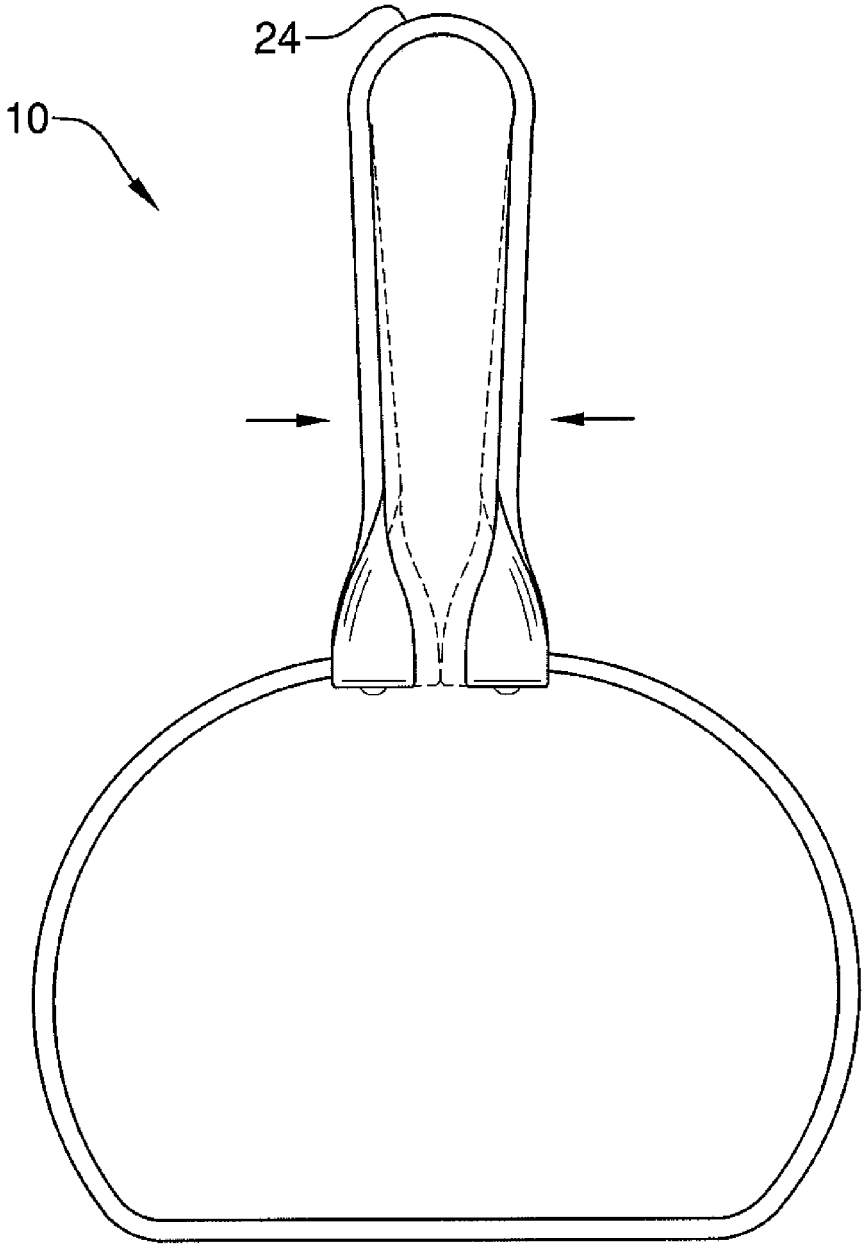
FIG. 2 is a top view of the present invention.
Figure 3:
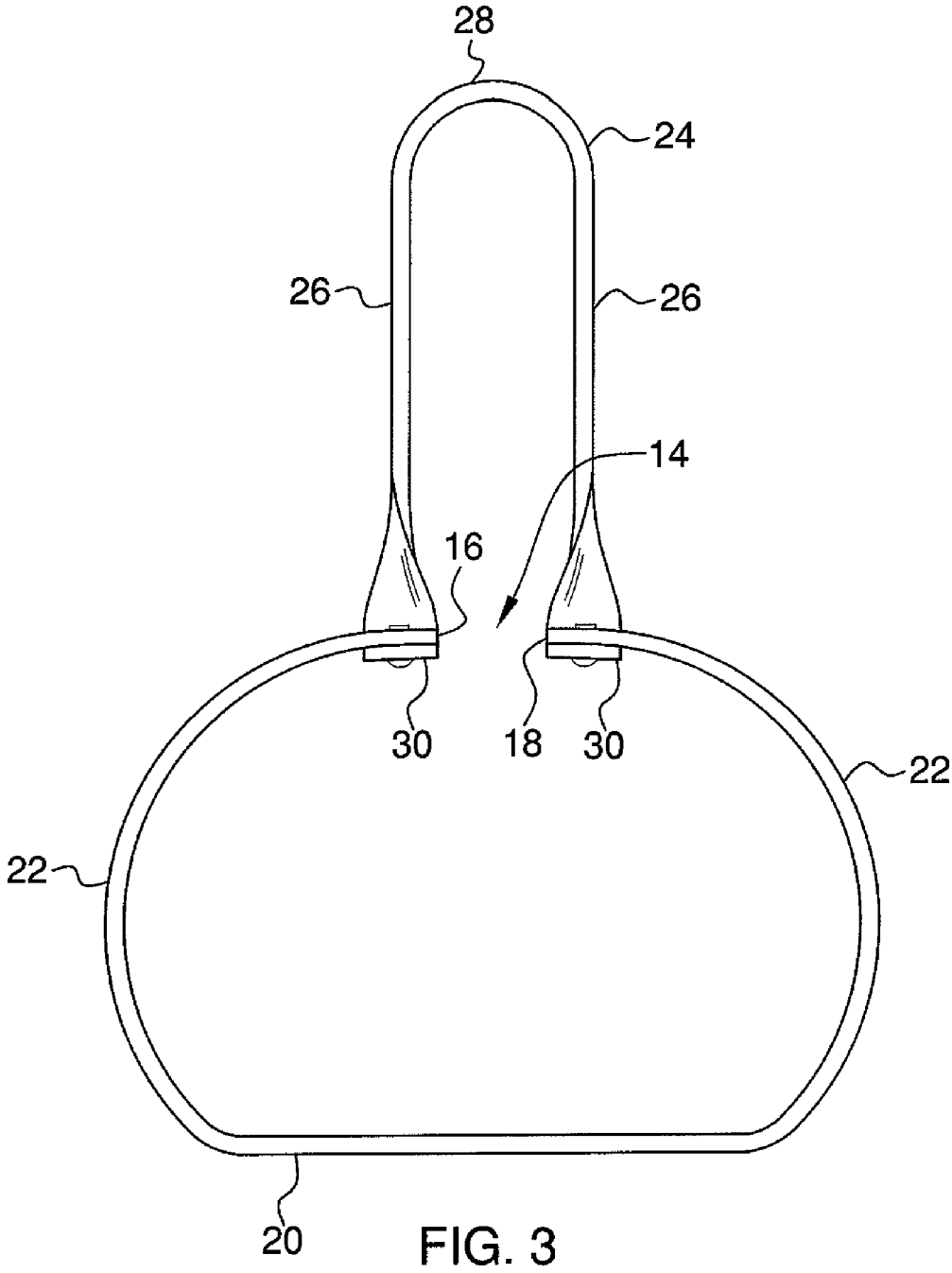
FIG. 3 is a bottom view of the present invention.
Figure 4:
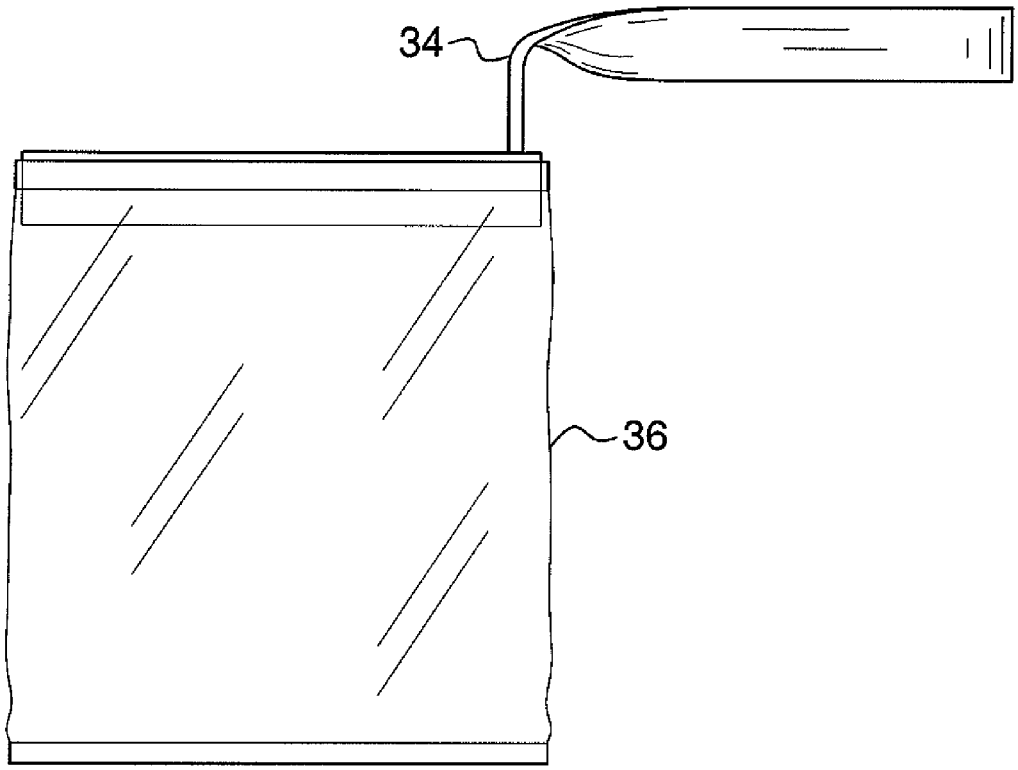
FIG. 4 is a side in-use view of the present invention.
Figure 5:
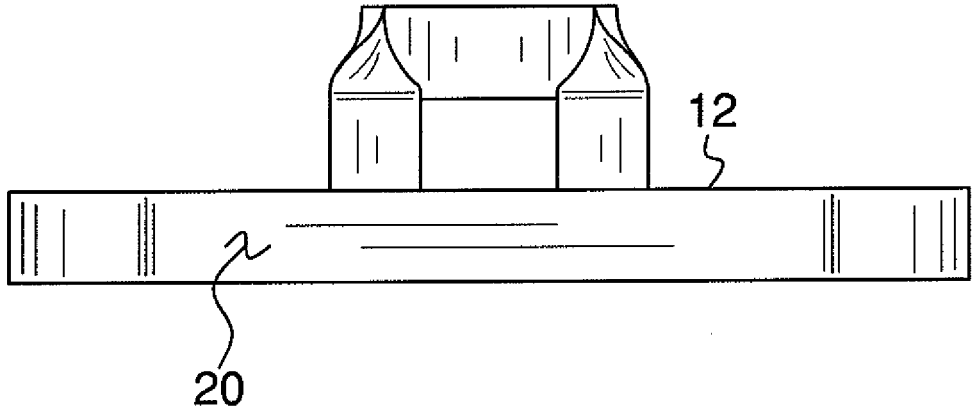
FIG. 5 is a front view of the present invention.
Figure 6:
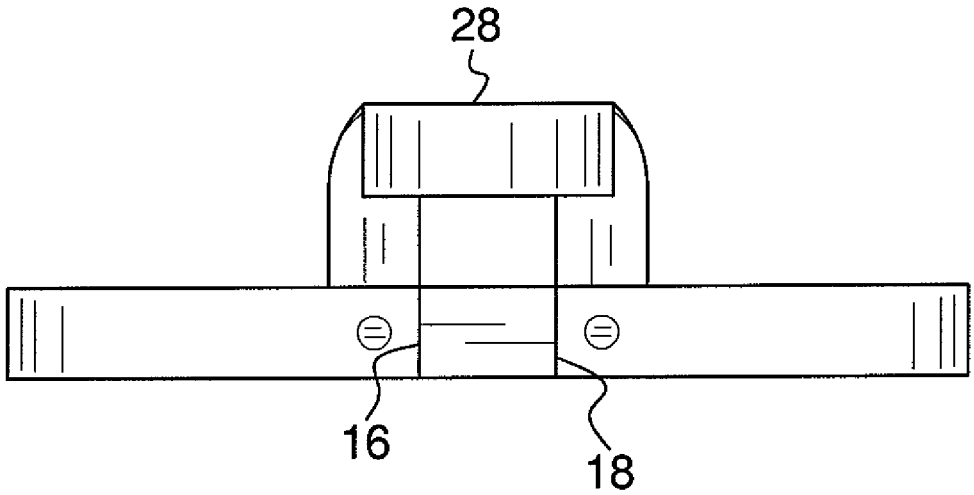
FIG. 6 is a rear view of the present invention.
Figure 7:
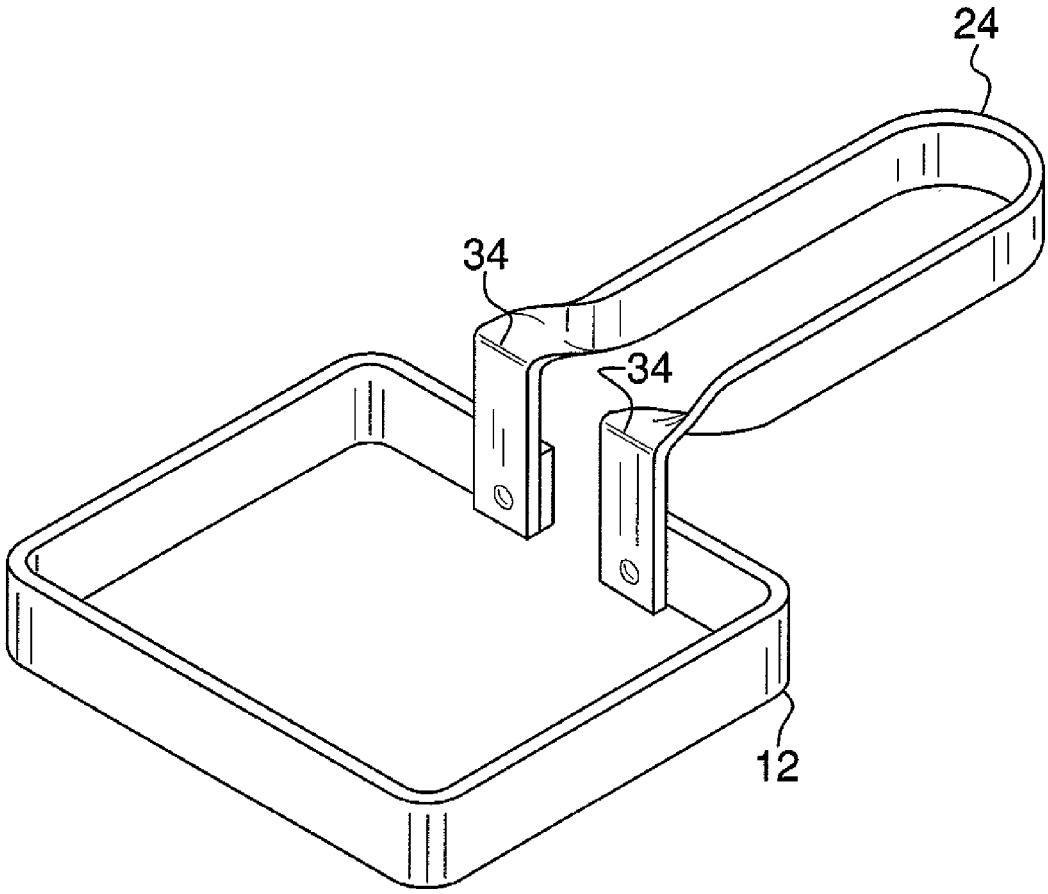
FIG. 7 is a top perspective view of an embodiment of the present invention.

With reference now to the drawings, and in particular to FIGS. 1 through 7 thereof, a new dog waste collecting device embodying the principles and concepts of the present invention and generally designated by the reference numeral 10 will be described.

As best illustrated in FIGS. 1 through 7, the dog waste collecting assembly 10 generally comprises a loop 12 having a break 14 therein to define a first free end 16 and a second free end 18. The loop 12 includes an elongated linear portion 20 that is positioned opposite of the break 14 so that a line orientated perpendicular to the linear portion 20 is extendable through the break 14 and between the first 16 and second 18 free ends. The loop 12 is comprised of a resiliently bendable material. The bendable material resists abutment of the first free end 16 and the second free 18. The material may be a plastic or metallic material. As can be seen in FIG. 1, the loop 12 may include a pair of arcuate lateral portions 22 attached to and extending between the linear portion 20 and corresponding ones of the first 16 and second 18 free ends. Another embodiment, found in FIG. 7, includes a loop 12 having a rectangular configuration.

A handle 24 is attached to the loop 12 and is spaced from the linear portion 20. The handle 24 includes a pair of arms 26 and a central member 28 that is attached to and extends between the arms 26. Each of the arms 26 has a distal end 30 with respect to the central member 28 and each of the first 16 and second 18 free ends has one of the distal ends 30 attached thereto. The distal ends 30 are urged towards each other to pull the first 16 and second 18 free ends together to decrease a size of a perimeter of the loop 12. A distance between the arms 26 is between ½ inch and 2 inches and the handle 24 has a length from the loop 12 to the central member 28 between 2.5 inches and 4 inches. The loop 12 has a greatest diameter measured along a ling orientated parallel to the linear portion 20 between 4 inches and 8 inches. Additionally, each of the arms 26 may include a bend 34 therein to place the loop 12 in a horizontal plane orientated parallel to and positioned below a plane of the handle 24. The distance between the loop 12 and the bends 34 is between ½ inch and 2 inches. The linear portion 20 has a length between the arcuate portions 22 at least equal to 3 inches.

In use, the loop 12 is extendable into an open end of a bag 36 when the first 16 and second 18 free ends are urged together. This decreases the size of the loop 12 so that it more readily fits into the bag 36. The first 16 and second 18 free ends are then allowed to move apart from each other to frictionally engage the bag 36. This allows bags 36 of different sizes to be used for easy retrofitting of bags to the loop 12. The bag 36 may include a conventional plastic bag that is sealable. Once the bag 36 is positioned on the loop 12, the loop 12 is used to scoop up animal waste, particularly from a dog. The linear portion 20 assists the person in creating an elongated flat section for abutting against a ground surface to further increase the ease of scooping the waste. One the animal waste has been scooped into the bag 36, the bag 36 is then removed and the top sealed using a conventional zip seal so that the bag may be safely positioned within clothing. At a later time, the bag may then be discarded when convenient. When the loop 12 is to be used again, a new bag 36 is placed on the loop 12. This process may be aided by an included elongated panel 38, such as those uses as tongue depressors, which can be used to push or scrape animal waste through the loop 12 and into the bag 36.

With respect to the above description then, it is to be realized that the optimum dimensional relationships for the parts of the invention, to include variations in size, materials, shape, form, function and manner of operation, assembly and use, are deemed readily apparent and obvious to one skilled in the art, and all equivalent relationships to those illustrated in the drawings and described in the specification are intended to be encompassed by the present invention.

Therefore, the foregoing is considered as illustrative only of the principles of the invention. Further, since numerous modifications and changes will readily occur to those skilled in the art, it is not desired to limit the invention to the exact construction and operation shown and described, and accordingly, all suitable modifications and equivalents may be resorted to, falling within the scope of the invention.

I claim:

1. A dog waste collecting assembly comprising:

a loop having a break therein to define a first free end and a second free end, said loop being comprised of a resiliently bendable material, said bendable material resisting abutment of said first free end and said second free, said loop including an elongated linear portion, said loop including a pair of arcuate lateral portions attached and extending between said linear portion and corresponding ones of said first and second free ends;

a handle being attached to said loop;

wherein said loop is extendable into an open end of a bag when said first and second free ends are urged together and then said first and second free ends are allowed to move apart from each other to frictionally engage the bag to allow the bag to receive waste scooped up with said loop; and said handle including a pair of arms and a central member being attached to and extending between said arms, each of said arms having a distal end with respect to said central member, each of said first and second free ends having one of said distal ends attached thereto, said distal ends being urged towards each other to pull said first and second free ends together to decrease a size of a perimeter of said loop.

2. The assembly according to claim 1, wherein said linear portion is positioned opposite of said break, a line orientated perpendicular to said linear portion being extendable through said break and between said first and second free ends.

3. The assembly according to claim 1, further including elongated panel being graspable to push animal waste through said loop and into the bag.

4. A dog waste collecting assembly comprising:

a loop having a break therein to define a first free end and a second free end, said loop including an elongated linear portion, said linear portion being positioned opposite of said break, a line orientated perpendicular to said linear portion being extendable through said break and between said first and second free ends, said loop being comprised of a resiliently bendable material, said bendable material resisting abutment of said first free end and said second free, said loop including a pair of arcuate lateral portions attached and extending between said linear portion and corresponding ones of said first and second free ends;

a handle being attached to said loop, said handle being spaced from said linear portion, said handle including a pair of arms and a central member being attached to and extending between said arms, each of said arms having a distal end with respect to said central member, each of said first and second free ends having one of said distal ends attached thereto, said distal ends being urged towards each other to pull said first and second free ends together to decrease a size of a perimeter of said loop, a distance between said arms being between ½ inch and 2 inches, said handle having a length from said loop to said central member between 2.5 inches and 4 inches, said loop having a greatest diameter measured along a ling orientated parallel to said linear portion between 4 inches and 8 inches; and wherein said loop is extendable into an open end of a bag when said first and second free ends are urged together and then said first and second free ends are allowed to move apart from each other to frictionally engage the bag to allow the bag to receive waste scooped up with said loop.

5. The assembly according to claim 4, further including elongated panel being graspable to push animal waste through said loop and into the bag.

6. A method of collecting dog waste including, said method including the steps of:

placing a bag on a loop having a break therein to define a first free end and a second free end by urging the first and second free ends together to form a small enough loop to allow it to be extended into the bag and released to frictionally engage the bag, said loop including an elongated linear portion positioned opposite of said break, said loop including a pair of arcuate lateral portions attached and extending between said linear portion and corresponding ones of said first and second free ends, said loop being comprised of a resiliently bendable material, said bendable material resisting abutment of said first free end and said second free;

gripping a handle being attached to said loop, said handle being spaced from said linear portion, said handle including a pair of arms and a central member being attached to and extending between said arms, each of said arms having a distal end with respect to said central member, each of said first and second free ends having one of said distal ends attached thereto, said distal ends being urged towards each other to pull said first and second free ends together to decrease a size of a perimeter of said loop; and positioning the loop adjacent to a ground surface and moving dog feces into the bag with an elongated panel.

* * * * *